US010961705B2

(12) United States Patent
Yu et al.

(10) Patent No.: US 10,961,705 B2
(45) Date of Patent: Mar. 30, 2021

(54) BAFFLE SYSTEM

(71) Applicant: Ivekter Inc., Mississauga (CA)

(72) Inventors: Le Yu, Mississauga (CA); Douglas G. Barlett, Mississauga (CA)

(73) Assignee: Ivekter Inc., Ontario (CA)

( * ) Notice: Subject to any disclaimer, the term of this patent is extended or adjusted under 35 U.S.C. 154(b) by 0 days.

(21) Appl. No.: 16/556,679

(22) Filed: Aug. 30, 2019

(65) Prior Publication Data

US 2021/0062506 A1 Mar. 4, 2021

(51) Int. Cl.

| | |
|---|---|
| ***E04B 9/00*** | (2006.01) |
| ***E04B 1/82*** | (2006.01) |
| ***E04B 9/22*** | (2006.01) |
| ***E04B 1/99*** | (2006.01) |
| *E04B 9/28* | (2006.01) |

(52) U.S. Cl.

CPC ..... *E04B 9/001* (2013.01); *E04B 1/82* (2013.01); *E04B 1/994* (2013.01); *E04B 9/225* (2013.01); *E04B 9/003* (2013.01); *E04B 9/28* (2013.01); *E04B 2001/8281* (2013.01)

(58) Field of Classification Search

CPC . E04B 1/82; E04B 1/994; E04B 9/001; E04B 9/003; E04B 9/225; E04B 9/28; E04B 2001/8281

See application file for complete search history.

(56) References Cited

U.S. PATENT DOCUMENTS

| | | | | |
|---|---|---|---|---|
| 3,182,773 A * | 5/1965 | Laaksonen | E04F 13/0803 | 52/506.06 |
| 3,755,988 A * | 9/1973 | Van Der Sluys | E04B 9/366 | 52/473 |
| 3,911,638 A * | 10/1975 | Englund | E04B 9/366 | 52/506.08 |
| 3,969,870 A * | 7/1976 | Deaton | E04B 9/34 | 52/645 |
| 4,364,215 A * | 12/1982 | Gailey | E04B 9/065 | 403/347 |
| 4,426,822 A * | 1/1984 | Gailey | E04B 9/366 | 52/506.06 |
| 4,471,596 A * | 9/1984 | Deaton | F21V 11/06 | 362/319 |
| 4,545,165 A * | 10/1985 | Carey | E04B 9/345 | 403/346 |

(Continued)

*Primary Examiner* — James M Ference

(74) *Attorney, Agent, or Firm* — Hartman Global IP Law; Gary M. Hartman; Domenica N. S. Hartman

(57) ABSTRACT

There is provided a ceiling baffle system having at least one ceiling support member and at least one baffle extending transversely relative to the at least one support member. The baffle has a baffle body portion with a baffle upper edge portion. At least one receiving slot extends from the upper edge into the body and receives the ceiling support member therewithin for coupling and suspending the baffle from the ceiling support member. At least one spacer extends parallel relative to the support member and has a spacer member body portion and a spacer member lower edge portion. At least one baffle retaining slot extends from the lower edge portion into the spacer member body portion. The baffle retaining slot receives at least the upper edge portion of the baffle to position, angularly orient and retain the baffle relative to the spacer member.

38 Claims, 9 Drawing Sheets

(56) References Cited

U.S. PATENT DOCUMENTS

| | | | | |
|---|---|---|---|---|
| 8,733,053 | B2 * | 5/2014 | Kabatsi | F16M 13/02 52/507 |
| 9,038,344 | B2 * | 5/2015 | Mayer | E04B 9/366 52/506.05 |
| 9,163,402 | B2 * | 10/2015 | Kabatsi | E04B 9/345 |
| 10,294,675 | B2 * | 5/2019 | Langeveld | F16B 5/125 |
| 10,808,402 | B2 * | 10/2020 | Adams | E04B 9/345 |
| 2005/0011150 | A1 * | 1/2005 | Stackenwalt | F16B 2/248 52/311.1 |
| 2006/0137799 | A1 * | 6/2006 | Haque | D04H 1/485 156/62.2 |
| 2008/0045101 | A1 * | 2/2008 | Near | B32B 5/26 442/35 |
| 2008/0251187 | A1 * | 10/2008 | Haque | D04H 1/72 156/148 |
| 2008/0266842 | A1 * | 10/2008 | Skidmore | F21S 2/00 362/147 |
| 2013/0142584 | A1 * | 6/2013 | Huchet | E04B 1/86 409/131 |
| 2017/0073968 | A1 * | 3/2017 | Kilian | E04B 9/127 |
| 2018/0283004 | A1 * | 10/2018 | Gillette | E04B 9/366 |

* cited by examiner

BAFFLE SYSTEM

TECHNICAL FIELD

The present disclosure generally relates to a baffle assembly for coupling with a ceiling support structure and more specifically to a baffle assembly for coupling with a ceiling support structure and having acoustic insulative properties.

BACKGROUND

Modern office and business floorplans often feature large contiguous spaces, with numerous acoustically reflective surfaces such as window walls, large displays, workstation furniture, and so forth. Without acoustic treatment, such spaces may easily suffer from reverberation, uncontrolled background noise, and reduced levels of speech intelligibility. These effects diminish worker comfort and productivity.

Acoustic treatments are available to lessen the amount of reflected sound along with its undesirable effects. One popular treatment option has been to hang series of panels, often called baffles, made from acoustically absorbent material from the ceiling or walls. These aid in controlling unwanted acoustic reflections and are usually designed and manufactured to have an aesthetically agreeable appearance.

The ceiling baffle systems known in the art generally require intermediate transverse supports, or additional hardware such as clips, hooks, hangers, and fasteners for proper installation. The spacing or positioning of the baffles must also be manually measured, which can be inconsistent and require further additional fixing hardware. These additional elements not only necessitate the additional material cost for their manufacture, but also the increased labor cost of their preparation and installation.

Additionally, such baffle systems are frequently installed as retro-fits, being attached to, or below, an existing suspended ceiling. This may require modification to the existing suspended ceiling supports, or may not offer the desired aesthetic result with the baffles hanging below a differently finished ceiling.

It is therefore desirable to have a ceiling baffle system which may easily be retro-fitted onto a new or existing suspended ceiling support structure, whereby the individual baffle elements may be spaced apart or aligned as desired, without the need for on-site measurement, intermediate support members, or hardware.

SUMMARY

The present disclosure generally relates to a baffle assembly for coupling with a ceiling support structure and more specifically to a baffle assembly for coupling with a ceiling support structure and having acoustically absorbent properties.

In one aspect, there is provided a ceiling baffle system having at least one ceiling support member. At least one baffle extends transversely relative to the at least one ceiling support member. The at least one baffle has a baffle body portion with a baffle upper edge portion. At least one receiving slot extends from the baffle upper edge portion into the baffle body portion and receives at least a portion of the ceiling support member therewithin for coupling and suspending the at least one baffle from the at least one ceiling support member. At least one spacer member extends parallel relative to the at least one ceiling support member and has a spacer member body portion and a spacer member lower edge portion. At least one baffle retaining slot extends from the spacer member lower edge portion into the spacer member body portion. The baffle retaining slot receives at least the baffle upper edge portion of the at least one baffle to position, angularly orient, and retain each baffle relative to the at least one spacer member.

The system may further include a horizontal flange portion extending longitudinally along the at least one ceiling support member and at least one longitudinally extending groove in the spacer member body portion for receiving therewithin and engaging by friction fit the horizontal flange portion. The system may include a second horizontal flange portion extending longitudinally along the at least one ceiling support member away from the horizontal flange portion and a cooperating spacer member having a second longitudinally extending groove therewithin for receiving therewithin and engaging by friction fit the second horizontal flange portion, the ceiling support member being sandwiched between the spacer member and the cooperating spacer member. A longitudinal channel may extend between the spacer member and the cooperating spacer member along a downward facing surface of the at least one ceiling support member. A linear luminaire may extend within the longitudinal channel. In another aspect, a coupling wall portion may extend between and couple top edge portions of each of the spacer member and the cooperating spacer member.

The at least one baffle or the at least one spacer member or both may comprise at least one of woven polyethylene terephthalate (PET) fiber material, non-woven needle-punched PET fiber material, thermo-formed PET material, thermo-bonded PET material, cast PET material, and any combination thereof. The at least one baffle or the at least one spacer member may include a plurality of material layers. The plurality of material layers may further comprise at least one layer of a PET material and at least one of the layers of the plurality of material layers has at least one of a different thickness and a different density. Further, at least one of the at least one baffle and the at least one spacer member may comprise at least one acoustically absorbent material.

The at least one baffle retaining slot may further include a plurality of baffle retaining slots spaced apart along the spacer member lower edge portion of the at least one spacer for positioning a plurality of baffles in spaced apart position relative to one another.

The ceiling baffle system may include at least one baffle deflection portion extending from the baffle body portion and positioned adjacent the at least one receiving slot. The at least one baffle deflection portion may be deformable for widening an opening of the at least one receiving slot. The system may include two baffle deflection portions extending from the baffle body portion on opposing sides of the at least one receiving slot. The two baffle deflection portions may define therebetween a constricted neck portion of the at least one receiving slot. A transverse slot portion may extend outwardly from an end portion of the constricted neck portion to define the receiving slot as a T-shaped slot.

The at least one ceiling support member may be a longitudinal T-shaped bar having a longitudinally extending vertical web portion and two longitudinally horizontal flange portions extending outwardly from an end portion of the longitudinally extending vertical web portion.

The at least one spacer member and the at least one baffle may be slidable along the at least one support member. The system may include at least one transverse ceiling support member intersecting with the at least one ceiling support member at a ceiling support member intersection. The system may include at least one adjustment notch extending from the spacer member lower edge portion into the spacer member body portion for allowing the at least one spacer member to slide along the at least one ceiling support member and across the ceiling support member intersection. In the aspect wherein the top edge portions of each of the spacer member and the cooperating spacer member are coupled by the coupling wall portion, at least one second adjustment notch continuous with the at least one adjustment notch may extend at least partially across the coupling wall portion between the spacer member and the cooperating spacer member.

The spacer may be configured to cover outwardly visible surfaces of the support member when installed thereon. The at least one spacer member may have a bottom wall portion extending across a bottom surface portion of the at least one ceiling support member and may have a longitudinal channel extending along the bottom wall portion of the at least one spacer member. A linear luminaire may extend within the longitudinal channel.

In one aspect, the at least one ceiling support member includes a plurality of ceiling support members spaced apart and parallel relative to one another, the at least one baffle includes a plurality of baffles spaced apart relative to one another, each baffle of the plurality of baffles having a plurality of receiving slots spaced apart for receiving each one of the plurality of ceiling support members, and, the at least one spacer member includes a plurality of spacer members, each spacer member having a plurality of baffle retaining slots for retaining at least the upper edge portion of each baffle therein.

The at least one ceiling support member may be pre-existing, and the at least one baffle and at least one spacer member are retro-fitted thereon.

In another aspect, there is provided a baffle system having a baffle having a longitudinal baffle body portion for extending transversely to at least one ceiling support member, the baffle body portion having a baffle upper edge portion. At least one receiving slot extends from the baffle upper edge portion into the baffle body portion, for receiving at least a portion of the ceiling support member and for suspending the baffle therefrom. A spacer member is provided having a longitudinal spacer member body portion for extending parallel relative to the at least one ceiling support member. The spacer member body portion has a lower edge portion. At least one baffle retaining slot extends from the lower edge portion of the spacer member into the body portion of the spacer member, for receiving at least a portion of the baffle to position, angularly orient and retain each baffle relative to the spacer member.

The baffle or the spacer member or both may further comprise at least one of woven polyethylene terephthalate (PET) fiber material, non-woven needle-punched PET fiber material, thermo-formed PET material, thermo-bonded PET material, cast PET material, and any combination thereof. Moreover, the baffle or the spacer member or both may be composed of a plurality of PET materials having at least one of different thicknesses and densities. Further, at least one of the baffle and the spacer member may comprise at least one acoustically absorbent material.

At least one baffle deflection portion may extend from the baffle body portion and be positioned adjacent the at least one receiving slot. The at least one baffle deflection portion may be deformable for widening an opening of the at least one receiving slot. In another aspect, the system may include two baffle deflection portions extending from the baffle body portion on opposing sides of the at least one receiving slot. The two baffle deflection portions may define therebetween a constricted neck portion of the at least one receiving slot. A transverse slot portion may extend outwardly from an end portion of the constricted neck portion to define the at least one receiving slot as a T-shaped slot.

The system may include at least one adjustment notch extending from the lower edge portion of the spacer member into the body portion of the spacer member for allowing the spacer member to slide along the ceiling support member and across a ceiling support member intersection wherein the ceiling support member intersects with a transverse ceiling support member.

The system may further include a cooperating spacer member having a second longitudinally extending groove therewithin for receiving therewithin and engaging by friction fit a second portion of the ceiling support member for sandwiching the ceiling support member between the spacer member and the cooperating spacer member. A coupling wall portion may extend between and couple top edge portions of each of the spacer member and cooperating spacer member in an aspect wherein the top edge portions of each of the spacer member. At least one second adjustment notch continuous with the at least one adjustment notch may extend at least partially across the coupling wall portion between the spacer member and the cooperating spacer member.

The at least one spacer member may have a bottom wall portion and a longitudinal channel may extend along the bottom wall portion of the at least one spacer member.

BRIEF DESCRIPTION OF THE DRAWINGS

Exemplary non-limiting embodiments are described with reference to the accompanying drawings in which.

DETAILED DESCRIPTION

The present disclosure generally relates to a baffle assembly for coupling with a ceiling support structure and more specifically to a baffle assembly for coupling with a ceiling support structure and having acoustically absorbent properties.

Figure 1:
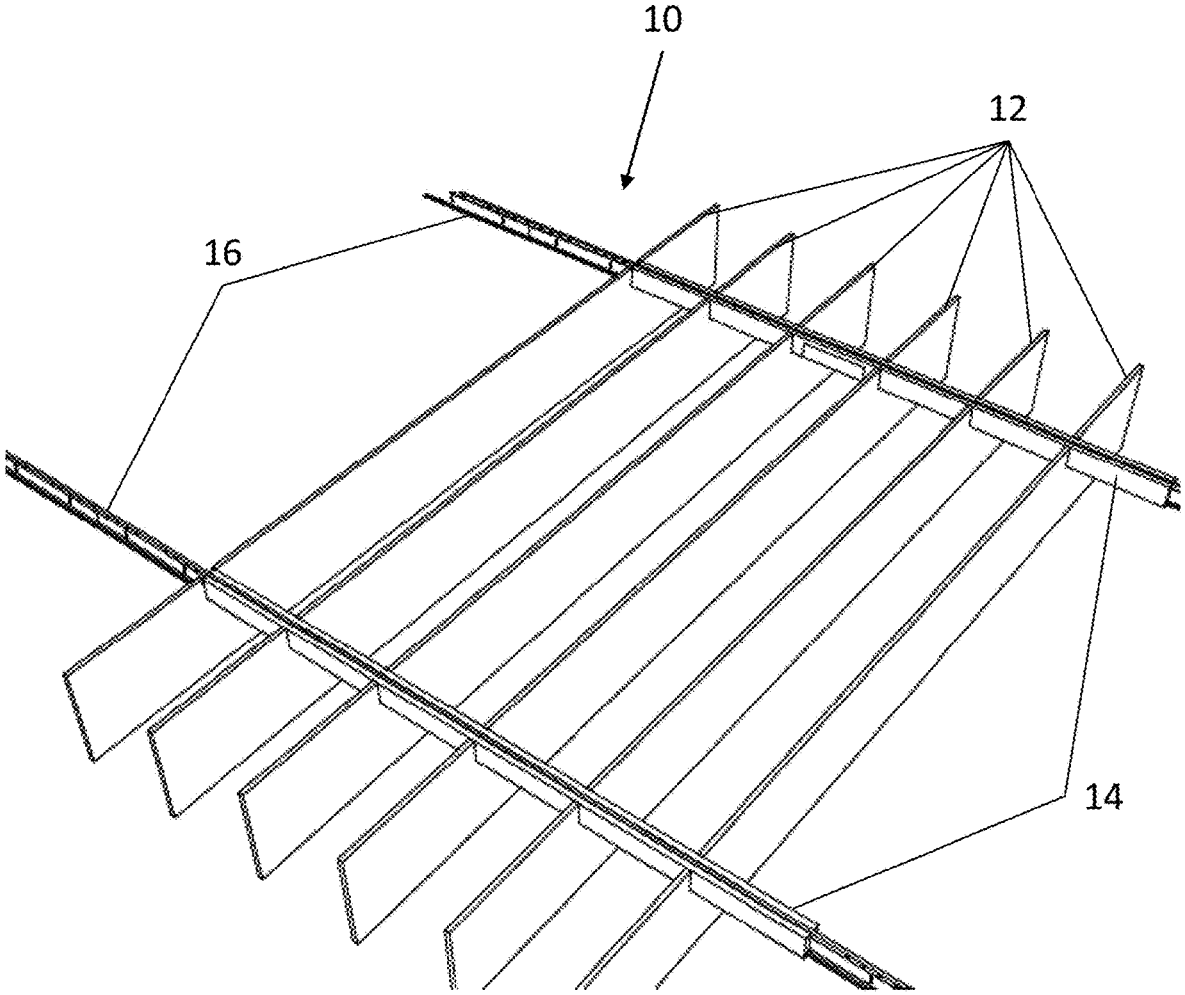
FIG. 1 is a perspective view of a ceiling baffle system of the present invention.

In the aspect shown in FIG. 1, there is provided a ceiling baffle system 10. The baffle system 10 includes a plurality of baffles 12 each spaced apart by a plurality of spacer members 14. The baffles 12 and the spacer members 14 are preferably made of an acoustically absorbent or insulative material as further discussed hereinafter. The baffles 12 and the spacer members 14 are each coupled with ceiling support members 16. The baffles 12 are preferably coupled with the ceiling support members 16 and extend transverse to the ceiling support members 16. Preferably, the baffles 12 each directly couple with and depend from the ceiling support members 16. The spacer members 14, when coupled with the baffles 12, retain the baffles 12 at a predetermined spacing therebetween, along the ceiling support members 16. The spacer members 14 also retain each individual baffle in at least one of position and angular orientation relative to the spacer members 14.

The spacer members 14 thereby provide a means for spacing the baffles 12 relative to one another and also for retaining the baffles 12 in position and angular orientation relative to the spacer members 14. This provides advantage as it facilitates the installation process of baffle system 10 by reducing or eliminating the need to manually measure and align the baffles 12 on-site and during installation.

While FIG. 1 shows the preferred embodiment of the ceiling baffle system 10 having a plurality of baffles 12, spacer members 14, and ceiling support members 16, it should be noted that the ceiling baffle system 10 of the present invention may include as few as a single baffle 12, a single spacer member 14, and single ceiling support member 16.

The ceiling baffle system 10 herein disclosed may be configured for installation onto a purpose-built set of ceiling support members 16, or may be retro-fitted onto an existing set of ceiling support members 16. Moreover, although it is preferable that the ceiling support members 16 be suspended from a ceiling prior to installation of the ceiling baffle system thereon, it should be understood that the ceiling support members 16 may first have the ceiling baffle system 10 coupled therewith and then may be suspended from the ceiling.

While the ceiling support members 16 shown in the accompanying Figures are a T-bar support, as is commonly used for suspended or drop ceilings, it should be understood that any ceiling support member or structure of a type suitable for hanging a finished ceiling may be used. Accordingly, it is not required that the ceiling support member has a standard T-bar configuration.

Figure 2A:
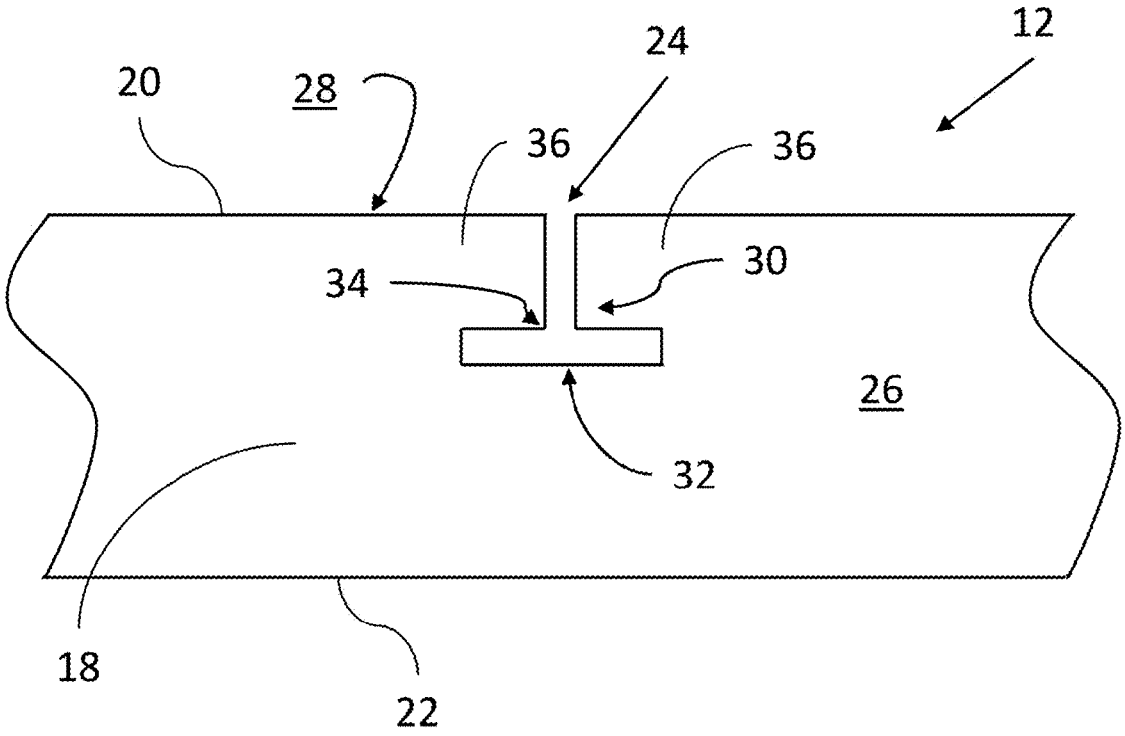
FIG. 2*a* is a side view of a section of a baffle with receiving slot.
Figure 2B:
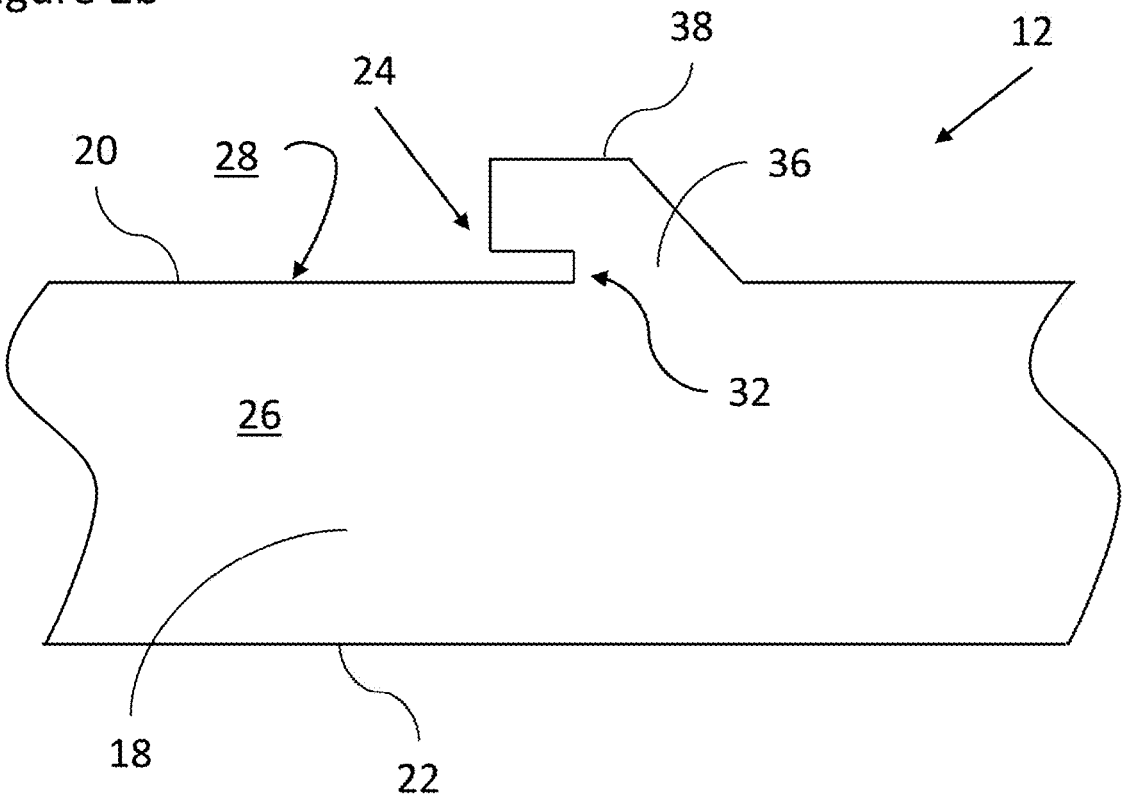
FIG. 2*b* is a side view of a section of the baffle with receiving slot according to another aspect.

As shown in FIGS. 2*a* and 2*b*, the baffle 12 includes a baffle body portion 18, a baffle upper edge portion 20 and a baffle lower edge portion 22. Extending from the baffle upper edge portion 20 into the baffle body portion 18 is a receiving slot 24 for receiving therewithin and coupling to a ceiling support member 16. Such coupling may be performed without the need for additional tools or hardware such as clips or fasteners. Preferably, each baffle 12 is formed as a panel or board and the baffle body portion 18 extends between a first surface portion 26, illustrated in FIGS. 2*a* and 2*b* as a front-facing surface portion, and a second surface portion 28 oppositely disposed from the first surface portion 26, which is not visible in FIGS. 2*a* and 2*b* as it is rear-facing.

In the embodiment shown in FIG. 2*a*, the receiving slot 24 is a T-slot or T-shaped slot formed through the baffle body portion 18, preferably between the first surface portion 26 and the second surface portion 28, and intersecting the baffle upper edge portion 20. The receiving slot 24 of FIG. 2*a* includes a constricted neck portion 30 and a transverse slot portion 32 extending outwardly from an end portion 34 of the constricted neck portion 30. The constricted neck portion 30 is bounded on either side by baffle deflection portions 36. In the embodiment shown in FIG. 2*b*, there is provided a projection 38 such as a hanger tab. The receiving slot 24 of FIG. 2*b* includes the transverse slot portion 32, which is formed as a gap between baffle upper edge portion 20 and the hanger tab 38 protruding therefrom. Adjacent the transverse slot portion 32 is the baffle deflection portion 36.

The generally rectangular baffles 12 shown in FIGS. 2*a*, and 2*b* are representative only and could be made to have any aesthetically or acoustically advantageous shape also having the elements herein described. It should be understood, therefore, that the baffles 12 are not limited to a board or panel configuration but may take other configurations, such as tubes or other closed or open or solid or hollow shapes and configurations.

The baffle body portion 18 is preferably composed of an acoustically absorbent material. Such materials may include, for example, various types of polyethylene terephthalate (PET) material, including woven (PET) fiber material, non-woven needle-punched PET fiber material, thermo-formed PET material, thermo-bonded PET material, cast PET material, or any combination thereof. While the PET materials listed may represent one set of preferable materials, it will be apparent to persons skilled in that art that any material which can be fashioned into a baffle-like structure may be used, including glass or mineral fiber materials, polymer foams, and other suitable materials. The baffle 12 may be constructed of a monolithic single material, or may be composed of a plurality of materials in layers. Where the baffle 12 is composed of a plurality of layers, at least one layer may be composed of a PET material, and at least one of the layers of the plurality of material layers has at least one of a different thickness and a different density from the PET material. Accordingly, the baffle 12 may be composed of materials having the same or different thicknesses and densities.

It is also preferable that at least the portion of the baffle 12 immediately adjacent to the receiving slot 24, and preferably the entire baffle 12, is made of a deformable material which may be twisted, bent or flexed. Preferably, the material from which baffle 12 is made is also resilient so that the baffle 12 may return at least approximately to its original form after having been deformed. Such a material provides for opening and closing of the receiving slot 24 when the embodiment shown in FIG. 2*a* is used, or when coupling the projection 38 with the ceiling support member 16 when the embodiment shown in FIG. 2*b* is used, for example. Such a deformable material provides further advantage in any of the embodiments described herein as it facilitates installation by allowing for bending or deflection of the baffle 12 or portions thereof to accommodate the baffle 12 to nuances or tolerances in assembly and installation which may or may not have been accounted for.

The embodiments illustrated in FIGS. 2*a* and 2*b* show two potential configurations for the receiving slot 24 for coupling with ceiling support members 16 having a T-bar configuration. However, it should be understood that the receiving slot 24 may take other forms to accommodate different types or sizes of ceiling support members 16, different installation methods, or to have a particular desired aesthetic. Thereby, the receiving slot 24 may include any configuration which enables the direct coupling or attachment of the baffle 12 to the ceiling support member 16. The receiving slot 24 may be manufactured as part of a cut-out, a protrusion, or a clipping or hooking element, which receives and engages a portion of the ceiling support member 16, and which is able to support the weight of the baffle 12 therefrom when the baffle 12 is suspended from one or more ceiling support members 16.

Figure 3A:
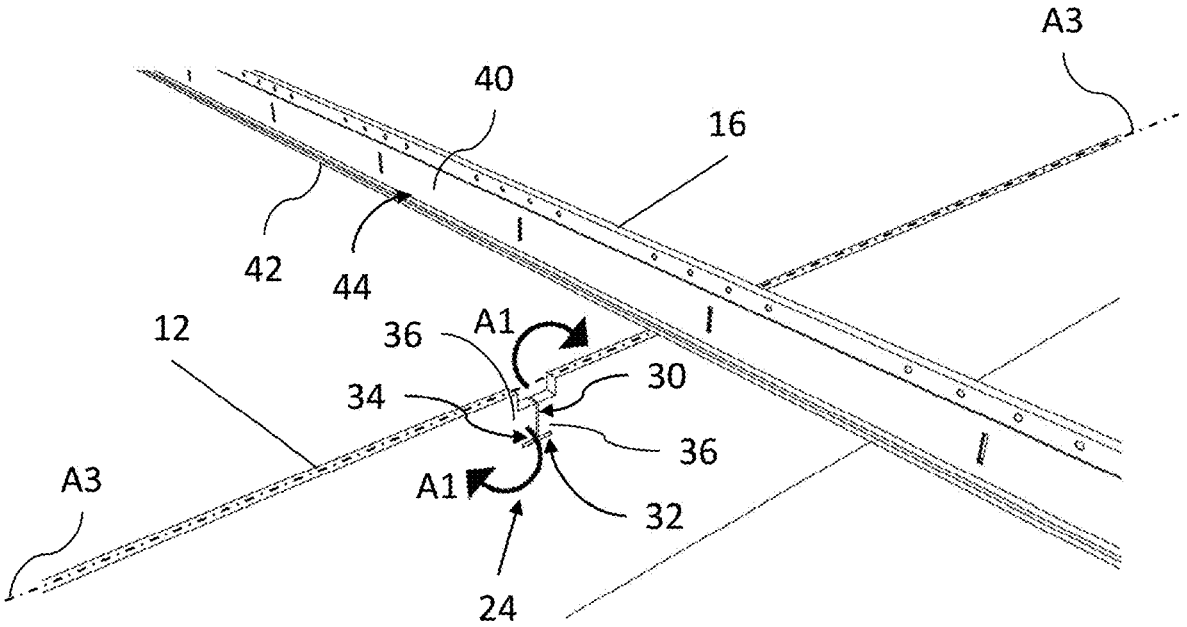
FIG. 3*a* is a perspective view of a first baffle prior to coupling with a ceiling support member.
Figure 3B:
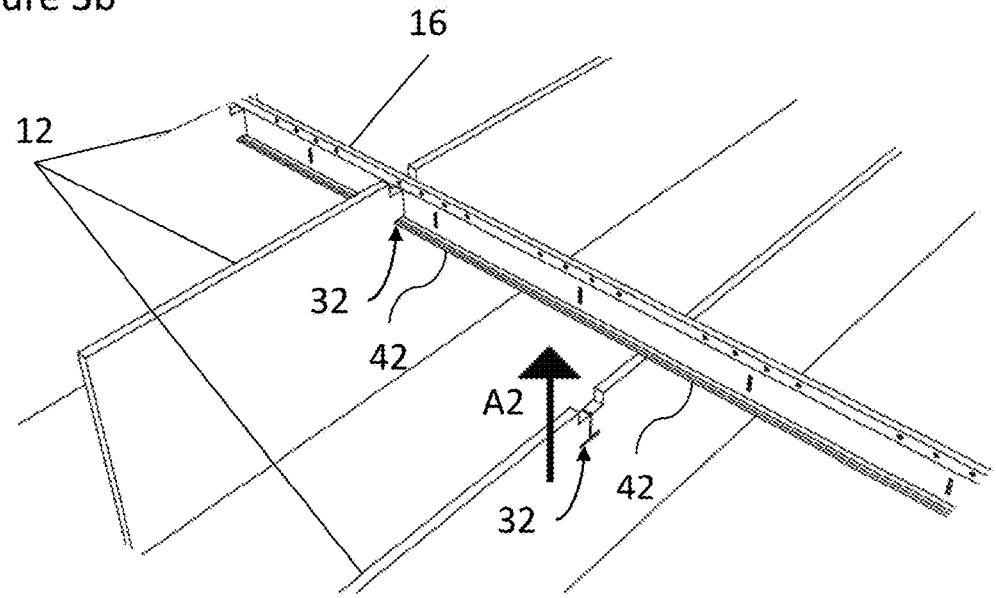
FIG. 3*b* is a perspective view of a second baffle being coupled with a ceiling support member.

FIGS. 3*a* and 3*b* illustrate the coupling with or installation of the baffles 12 onto a ceiling support member 16, wherein the ceiling support member 16 is a T-shaped support or "T-bar" having a vertical web portion 40 and at least one but preferably two horizontal flange portions 42 extending outwardly from an end portion 44 of the vertical web portion 40 and the receiving slot 24 is a T-shaped slot or T-slot as shown in FIG. 2*a* having the constricted neck portion 30 and the transverse slot portion 32.

As shown by way of curved arrows A1 in FIG. 3*a*, baffle deflection portions 36 of the baffle 12 adjacent the receiving slot 24 may be deflected or flexed away from the longitudinal axis A3 of the baffle 12. Such deflection of the baffle deflection portions 36 opens the constricted neck portion 30 of the receiving slot 24 to provide an opening sufficiently large to receive the ceiling support member 16 into the receiving slot 24.

As indicated by vertical arrow A2 in FIG. 3*b*, the baffle 12 is then moved to position the open receiving slot 24 about the ceiling support member 16 such that the horizontal flange portions 42 of the ceiling support member 16 are received within the transverse slot portion 32. The baffle deflection portions 36 adjacent the receiving slot 24 are then returned to their original positions in at least approximate alignment with longitudinal axis A3 of the baffle 12. The baffle deflection portions 36 may be returned to their original position either by way of forced manipulation or, if the baffle material is resilient, by elastic action of the baffle material. Once the baffle deflection portions 36 are returned to their original positions, the vertical web portion 40 of the ceiling support member 16 is located within the constricted neck portion 30 of the receiving slot 24, preferably tightly secured therebetween, and the horizontal flange portions 42 of the ceiling support member 16 are located within the transverse slot portion 32, also preferably tightly secured therewithin. Accordingly, the horizontal flange portions 42 of the ceiling support member 16 may not be freed from the transverse slot portion 32 without first deflecting the baffle deflection portions 36 in order to open the constricted neck portion 30. The receiving slot 24 captures the ceiling support member 16 therein. There is thereby provided a secure coupling between the baffle 12 to the ceiling support member 16.

It should be understood that the baffle system 10 preferably includes a plurality of ceiling support members 16 and a plurality of baffles 12. The process of receiving a ceiling support member 16 within a receiving slot 24 described above may be repeated as many times as is necessary to couple the remaining receiving slots 24 of the baffle 12, with the remaining ceiling support members 16 in the baffle system 10 from which the baffle 12 is to be suspended. The foregoing process is also repeated for each of the remaining baffles 12 to be installed in the ceiling baffle system 10. It should be understood that the spacing of the receiving slots 24 on the baffle 12 corresponds with the desired, or existing, spacing of the ceiling support members 16, or vice versa, and is preferably predetermined. Since the receiving slots 24 are spaced apart to correspond with the spacing of the ceiling support members, the baffle 12 may attach directly to the ceiling support member 16, without the need for any intermediate structures or fasteners.

Figure 4A:
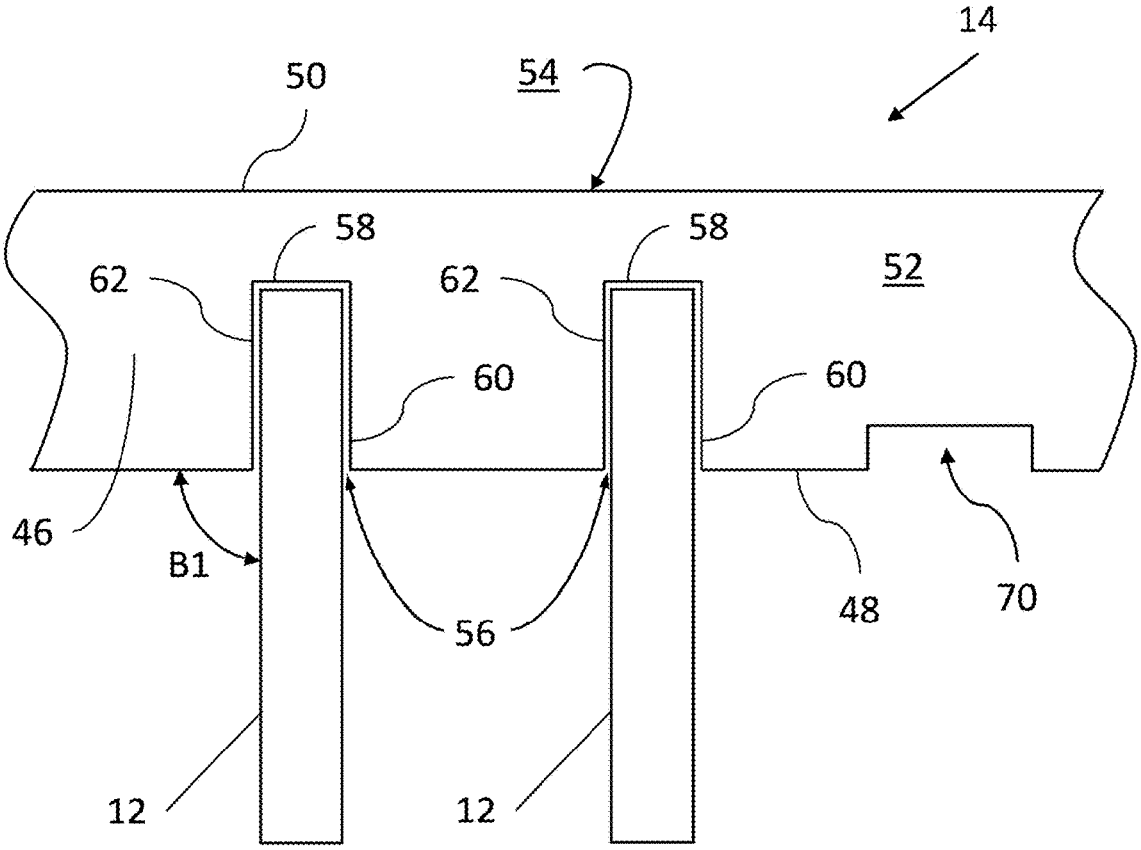
FIG. 4*a* is a side view of a section of one embodiment of the spacer member coupled with two baffles.
Figure 4B:
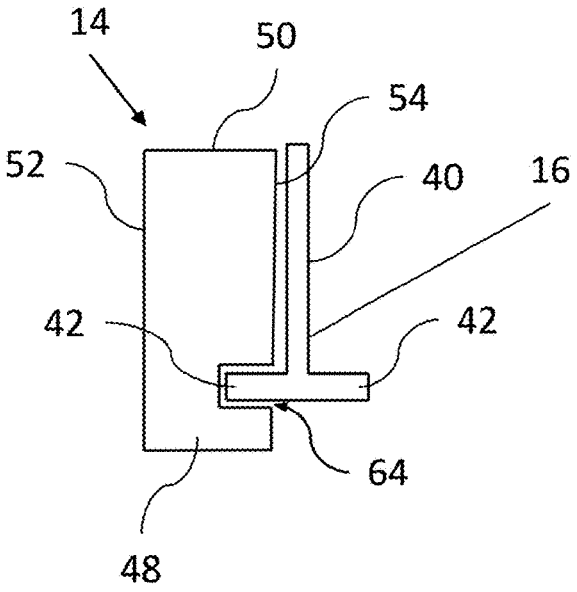
FIG. 4*b* is an end cross-sectional view of one embodiment of the spacer member.

There is also included in the ceiling baffle system 10 a spacer member 14 extending transverse to the baffles 12 and parallel to the ceiling support members 16, as illustrated in FIGS. 4*a* and 4*b*. The spacer member 14 spaces apart the baffles 12 along the ceiling support member 16 and angularly orients the baffles 12 relative to the ceiling support member 16. The spacer member 14 also retains the baffles 12 in the desired relative spacing therebetween along the ceiling support member 16 and preferably also retains the baffles 12 in their desired angular orientation relative to the ceiling support member 16. The spacer member 14 includes a spacer body portion 46, a bottom wall portion 48, a top surface portion 50, and oppositely disposed first side surface portion 52 and second side surface portion 54. The generally rectangular spacer member 14 shown is representative only. As with the baffles 12, the spacer members 14 can be made into any aesthetically or acoustically advantageous shape or configuration.

The spacer members 14 are preferably manufactured using the same materials and employing the same manufacturing processes as used for the baffles 12. This inherently matches the appearance between the baffles 12, and the spacer member 14. This not only provides aesthetic advantage, but also increases the acoustically absorbent surface area of the ceiling baffle system 10 by covering acoustically reflective surfaces of the ceiling support member 16.

At least one baffle retaining slot 56 extends from the spacer member bottom wall portion 48 into the spacer member body portion 46 toward the spacer member top surface portion 50 and completely between the first and second side surface portions 52, 54 of the spacer member body portion 46. The at least one baffle retaining slot 56 is for engaging and retaining each baffle 12. Accordingly, the baffle retaining slots 56 are preferably sized to allow the spacer member 14 to be slid onto and engage with each of the baffles 12.

For example, the baffle retaining slots 56 illustrated in FIG. 4*a* are rectangular, having a base wall portion 58 and an oppositely disposed first side wall portion 60 and a second side wall portion 62. Preferably, the engagement between the baffles 12 and the baffle retaining slots 56 is a compression fit or friction fit wherein the first and second side wall portions 60, 62 of the baffle retaining slots 56 are in tight contact with the baffles 12.

The baffle retaining slots 56, are also spaced apart from one another to set the position of each baffle 12 along the length of the spacer member 14. Preferably the spacing between baffles 12 is predetermined. The spacing between baffles 12 may be of uniform or equal distance, or may be a spacing which is aesthetically desirable such as a repeating pattern of different spacing distances, or a spacing which is acoustically advantageous such as a particular set of spacing distances to diminish or break up acoustic room modes. The spacing between baffles may also be of no particular pattern or uniformity.

The baffle retaining slots 56 also preferably serve to establish and maintain the angular orientation B1 of each baffle relative to the spacer member 14 and thereby ceiling support members 16. In the embodiment shown in FIG. 4*a*, the angular orientation is approximately 90 degrees. It should be understood that the baffle retaining slots 56, and hence the baffles 12, may be disposed at any suitable predetermined angular orientation. Accordingly, angular orientation B1 may represent any suitable angle.

Figure 5A:
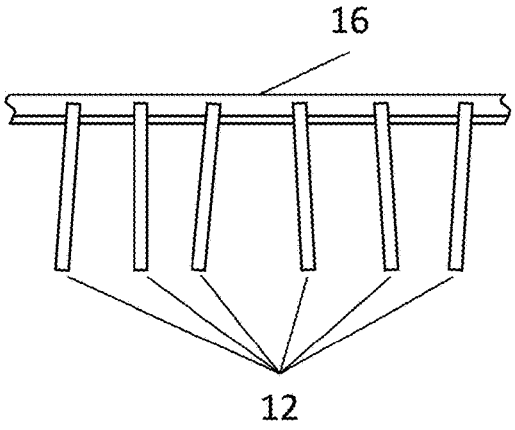
FIG. 5*a* is a side view of the baffles prior to coupling with the spacer member.
Figure 6A:
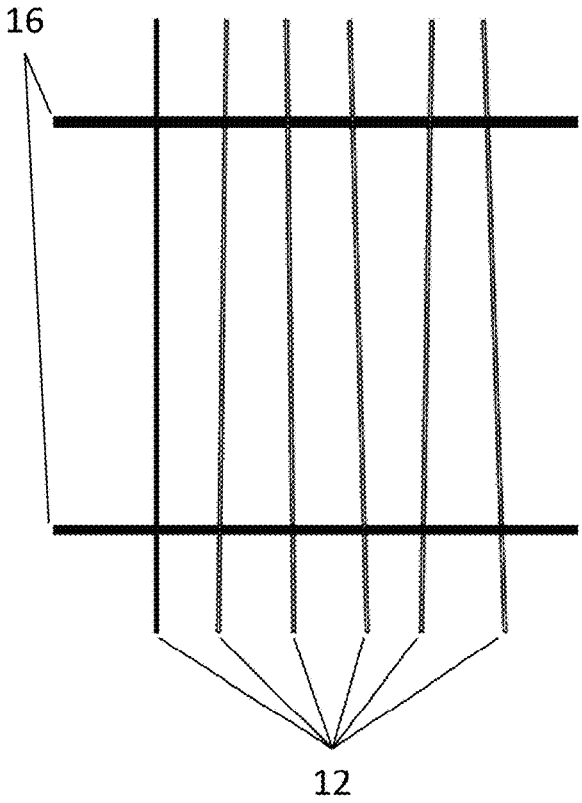
FIG. 6*a* is a top view of the baffles prior to coupling with the spacer member.

FIGS. 5*a* and 6*a* show a series of baffles 12 as might be arranged upon their initially being placed onto a pair of ceiling support members 16 and prior to installation of the spacer members 14 in the baffle system 10. The baffles 12 are shown in FIG. 5*a* to be at arbitrary angular orientations with respect to the ceiling support members 16. FIG. 6*a* shows the baffles 12 positioned with inaccurate or undesirable relative spacings along the ceiling support members 16. After placement on the ceiling support members 16, the baffles 12 must be positioned, oriented, and secured to complete their installation.

Figure 5B:
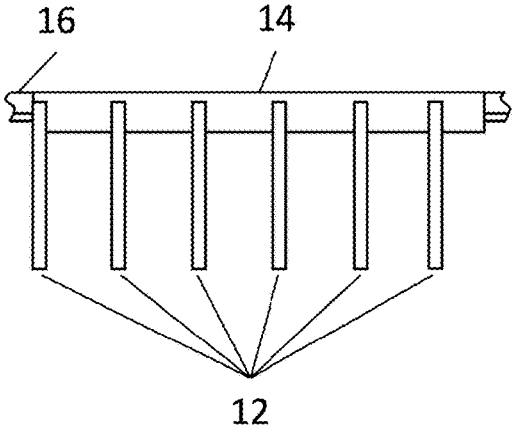
FIG. 5*b* is a side view of the baffles after coupling with the spacer member.
Figure 6B:
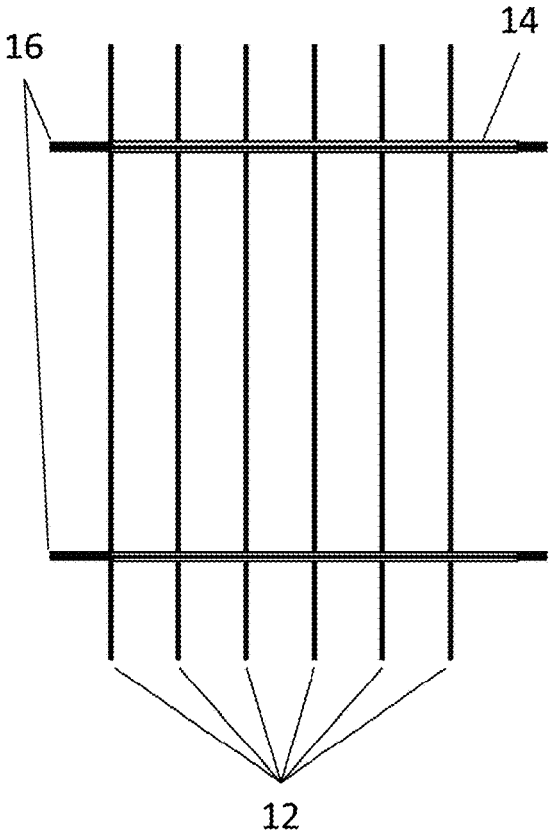
FIG. 6*b* is a top view of the baffles after coupling with the spacer member.

FIGS. 5*b* and 6*b* show that the spacer members 14 align and secure the baffles 12 into the predetermined or desired angular orientation relative to the ceiling support members 16, and at the predetermined or desired relative spacing one-to-another. In the instance shown in FIGS. 5*b* and 6*b*, the angular orientation between the baffles and the ceiling support members is 90 degrees and the relative spacing between the baffles is uniform. It should be understood that the spacer members 14 may secure and align the baffles 12 in other angular orientations or may position the baffles 12 at non-uniform relative spacing between the baffles 12. The installation of the spacer member 14 achieves this without the need for measuring and adjusting each baffle 12 into the correct position and orientation, nor for fastening or securing each individual interface point between the baffle 12 and the ceiling support member 16. This is all achieved with installation of the spacer member 14 as will be described hereinafter.

FIG. 4*b* shows the spacer member 14 further including a longitudinal groove 64 extending into the spacer member body portion 46 from the second side surface portion 54 toward the first side surface portion 52. The longitudinal groove is for cooperative engagement with the horizontal flange portion 42 which extends longitudinally along the ceiling support member 16. The longitudinal groove 64 of the spacer member 14 illustrated in FIG. 4*b* is a rectangular groove, but may be of any suitable shape to accept the horizontal flange portion 42 of the ceiling support member 16.

It is preferable that the position of the longitudinal groove 64 between the bottom wall portion 48 and the top surface portion 50 of the spacer member 14 is suitable to allow the longitudinal groove 64 to align with and cooperatively engage with one side of the horizontal flange of the T-bar ceiling support member 16 while also allowing the baffle 12 to be engaged with the baffle retaining slots 56. This cooperative engagement is preferably a friction fit or compression fit. Such an engagement may serve to keep the spacer from moving or shifting over time due to vibration, or to more effectively cover the acoustically reflective surfaces of the ceiling support member 16.

Figure 7A:
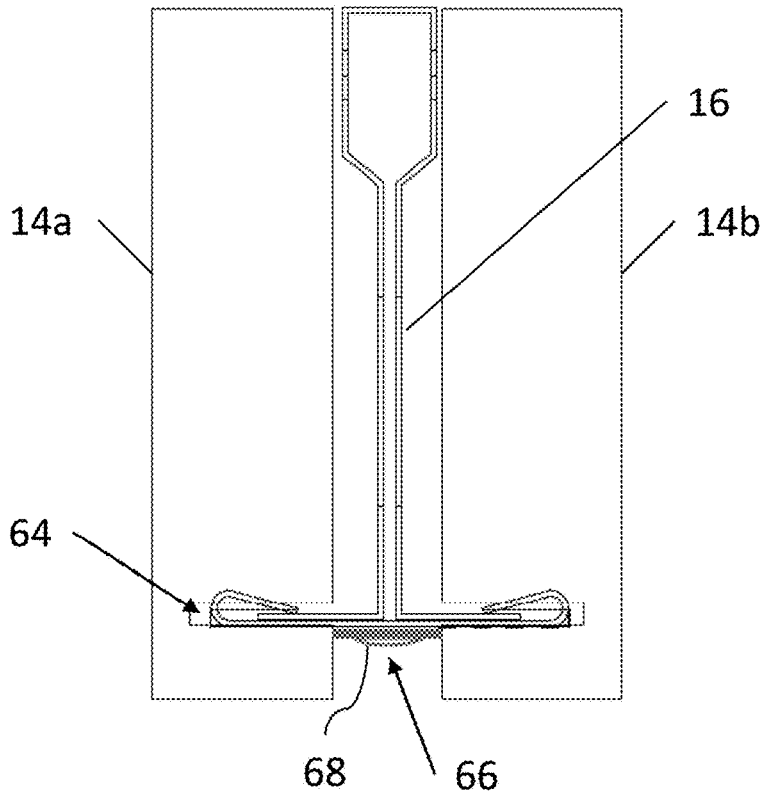
FIG. 7*a* is an end cross-sectional view of one embodiment wherein a spacer member and cooperating spacer member are coupled with a ceiling support member and having a linear luminaire positioned therebetween.

In an alternative embodiment, the spacer member 14 may include two independent spacer members 14*a* and 14*b*. The spacer member 14*a* and the second or cooperating spacer member 14*b* sandwich the ceiling support member 16 therebetween, as shown in FIG. 7*a*. Each spacer member 14*a*, 14*b* has its own longitudinal groove 64 for engagement with a respective one of the two horizontal flange portions 42 of the T-bar ceiling support member 16 and its own one or more baffle retaining slots 56 spaced apart there along as previously described above with respect to FIGS. 4*a* and 4*b*. Such an arrangement may provide for a more rigid final assembly of baffle system 10, a more aesthetically appealing result, or for improved acoustic insulative performance. For example, the use of two spacer members 14*a*, 14*b* provides for increased surface area coverage of the ceiling support member 16 by the acoustically insulative material of the spacer member 14.

Figure 7B:
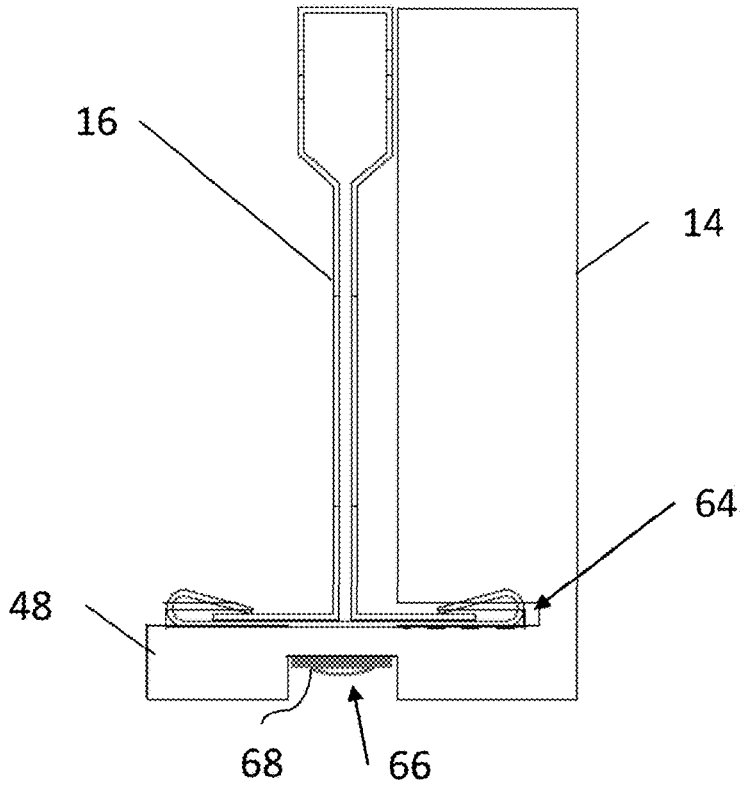
FIG. 7*b* is an end cross-sectional view of one embodiment of the spacer member coupled with a ceiling support member.

In the embodiment of FIG. 7*a*, the spacer members 14*a* and 14*b* provide a channel 66 therebetween extending along a bottom surface portion of the ceiling support member 16, which is downward facing when the ceiling support member 16 is suspended from the ceiling. Such a channel 66 may be further configured as a mounting location for one or more luminaires 68. For example, a linear luminaire 68 could be positioned in the channel 66 to extend at least partially therealong, thereby integrating a lighting solution into the ceiling baffle system 10. In an alternative embodiment, the spacer members 14*a* and 14*b* may also be configured to leave no channel therebetween and to entirely enclose the visible portions of the ceiling support members 16. In yet another embodiment shown in FIG. 7*b*, the bottom wall portion 48 of the at least one spacer member 14 extends across the downward facing surface portion of the ceiling support member 16 and a longitudinal channel 66 may extend along the bottom wall portion of the at least one spacer member 14. The longitudinal channel 66 may be configured to accommodate a linear luminaire 68 therewithin.

Figure 8:
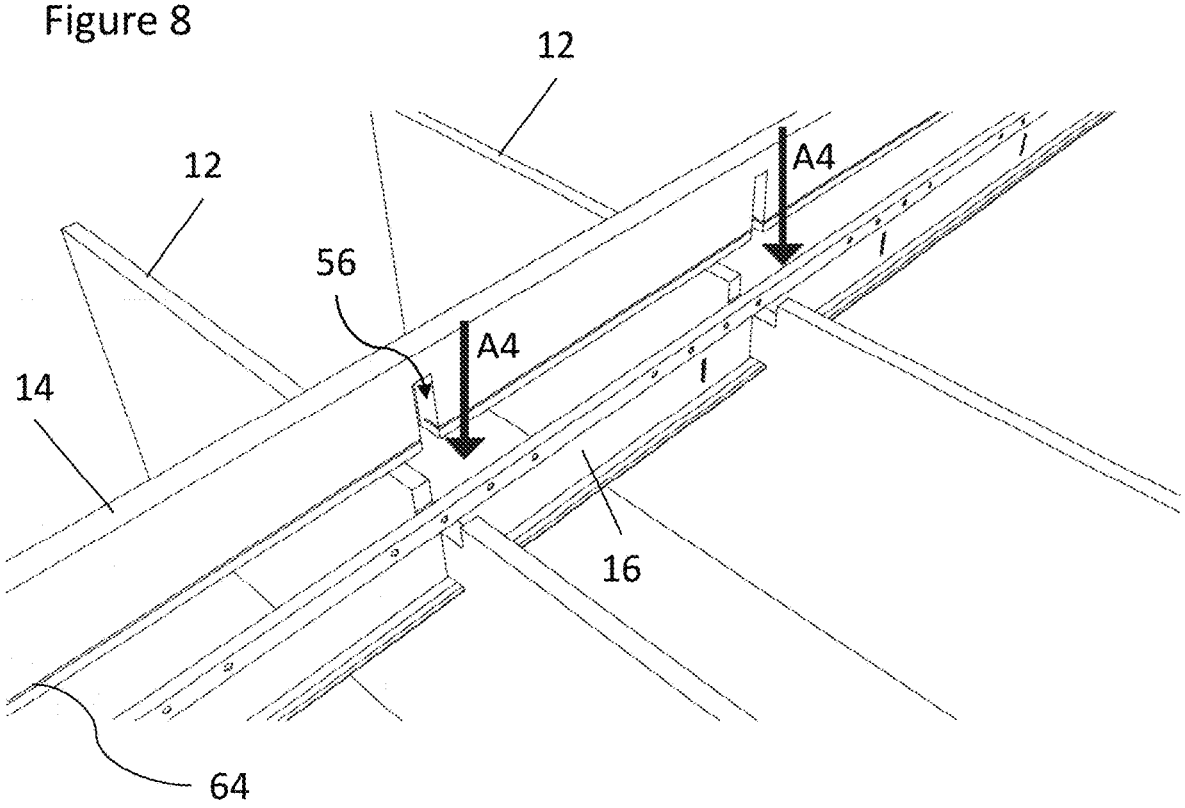
FIG. 8 is a perspective view of a spacer member being coupled with two spaced apart baffles and a ceiling support member.

FIG. 8 shows the installation of a spacer member 14 onto a set of baffles 12 and a ceiling support member 16. In the embodiment shown, the baffles 12 have already been attached to the ceiling support member 16, and are spaced apart to at least approximately match the spacing of the baffle retaining slots 56 of the spacer member 14. As shown by way of arrows A4, the spacer member 14 is preferably lowered vertically from above onto the baffles 12, allowing the baffles 12 to slide into the baffle retaining slots 56. The spacer member 14 is then slid horizontally towards the ceiling support member 16, to engage at least a portion of the ceiling support member 16 with the longitudinal groove 64 of the spacer member 14, in the manner previously described.

As is apparent from a combined reading of the foregoing Figures and description, the completed assembly may form an interlocking grid of a plurality of baffles 12 and ceiling support members 16 rigidly coupled by the spacer members 14. The baffles 12 are fixed along an axis perpendicular to the ceiling support members 16 by attachment thereto via the receiving slots 24 of the baffles 12. The baffles 12 are also fixed relative the spacer members 14, along an axis parallel to the ceiling support members 16, by engagement with the spacer members 14. The spacer members 14 are likewise fixed relative the baffles 12, along an axis perpendicular to the baffles 12, by engagement therewith. The spacer member 14 is however preferably able to slide relative the ceiling support members 16, along an axis A5 parallel to the ceiling support members 16, since in the preferred embodiment, it is only coupled by compression or friction fit with the horizontal flange portions 42 of the ceiling support members 16 by way of the spacer member longitudinal grooves 64.

Figure 9A:
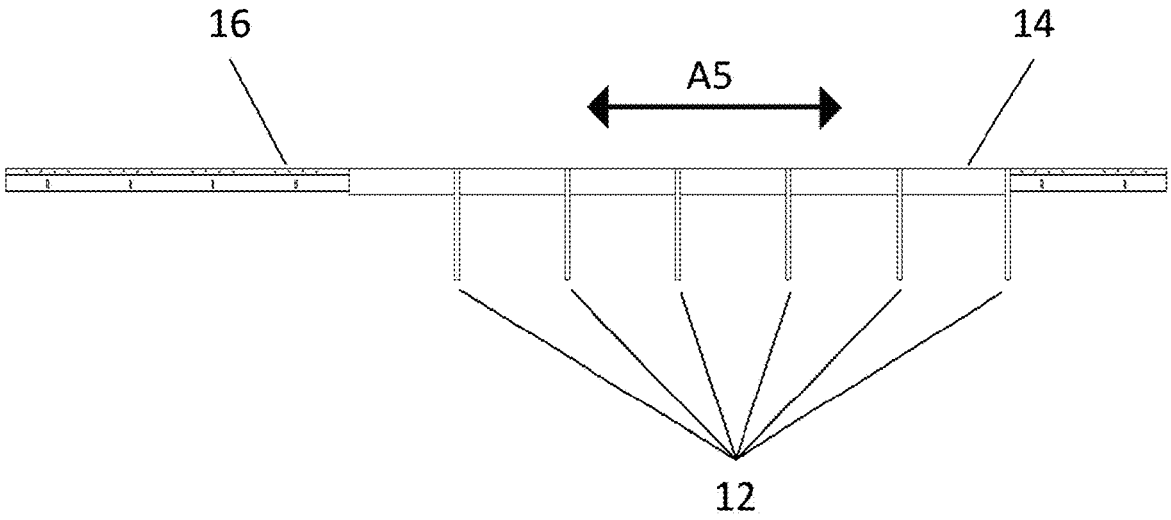
FIG. 9*a* is a side view of the baffle system coupled with ceiling support members; and, FIG. 9*b* is a side view of the baffle system coupled with ceiling support members and horizontally displaced along the ceiling support member relative to the position of the baffle system in FIG. 9*a*.
Figure 9B:
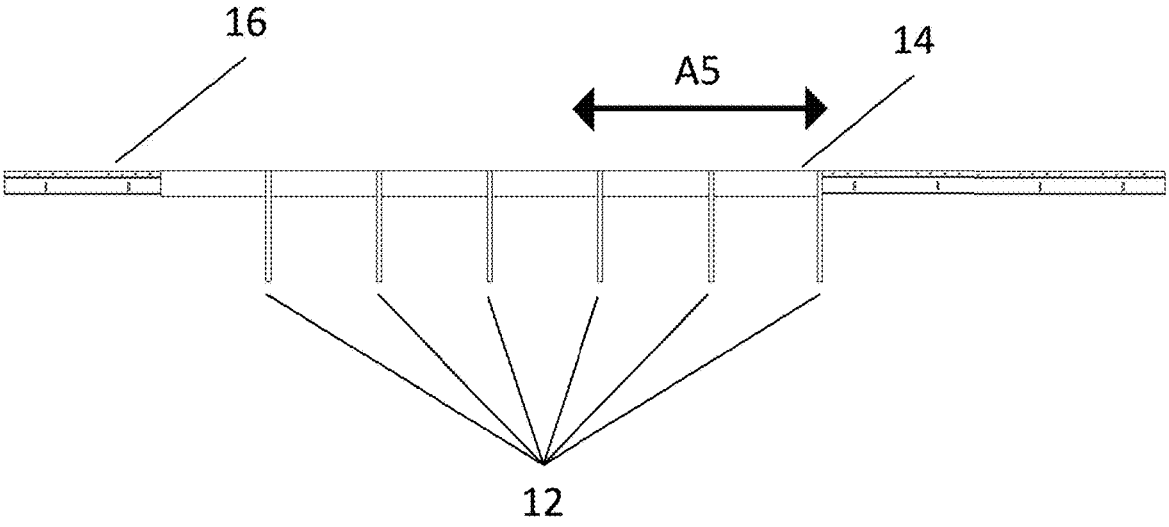

As such, the entire interlocked ceiling baffle system 10 may be slid or repositioned along the length of the ceiling support member 16 by applying sufficient force to overcome the friction of the compression or friction fit between the ceiling support members 16 and the spacer members 14. The ceiling baffle system 10 is shown in a first position in FIG. 9*a*, and is then slid or axially displaced along the ceiling support member 16 and axis A5, to a second position in FIG. 9*b*.

In some embodiments of the baffle system 10, the ceiling support structure also includes transverse ceiling support members (not shown) which extend transversely relative to the ceiling support members 16 and form ceiling support member intersections with the ceiling support members 16. In order to permit sliding of the spacer members 14 across the ceiling support member intersections, the spacer member 14 may include at least one adjustment notch 70, as shown in FIG. 4*a*, to allow the spacer member 14 to slide over transverse ceiling support member.

Allowing for the entire ceiling baffle system to slide relative the ceiling support members is advantageous. For example, it may allow for the position of the ceiling baffle system 10, either partially or completely assembled, to be adjusted into the final desired position without disassembly thereof. It may also simplify future adjustment or modification to the ceiling baffle system 10.

Figure 7C:
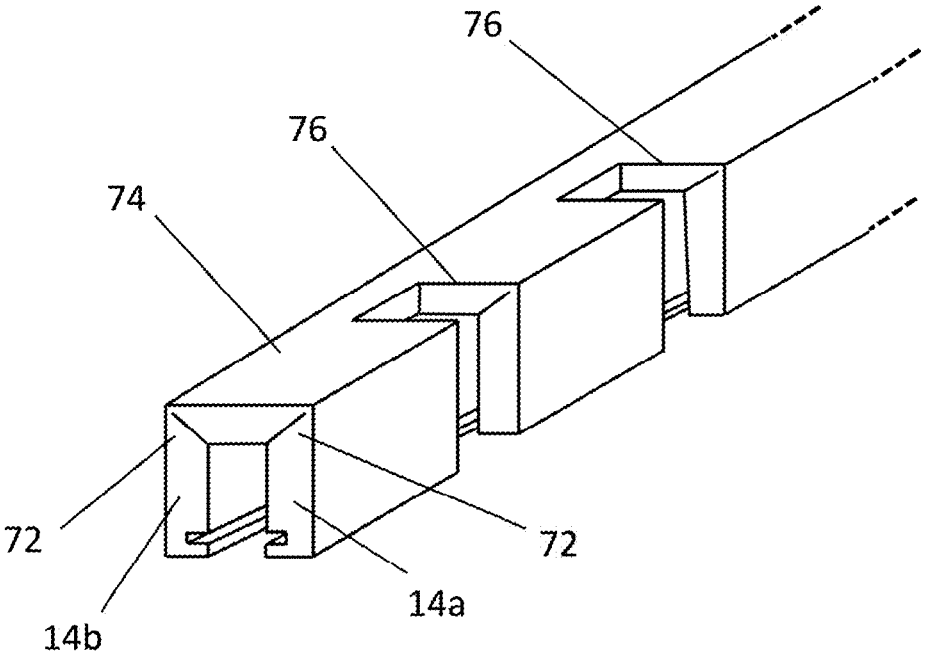
FIG. 7*c* is a perspective view of another embodiment of the spacer member and cooperating spacer member coupled with a ceiling support member.

In FIG. 7*c* there is shown a further aspect wherein the spacer member 14*a* and the cooperating spacer member 14*b* each have a top edge portion 72. The top edge portions 72 of the spacer member 14*a* and cooperating spacer member 14*b* are coupled together by coupling wall portion 74. Extending at least partially across the coupling wall portion 74 is at least one second adjustment notch 76 which is continuous with the at least one adjustment notch 70 of the spacer member 14*a*. Thereby, there is provided a further aspect wherein the spacer member 14*a* and cooperating spacer member 14*b* may be fabricated or cut from a continuous body of material. Further advantage is provided whereby the top edge portion of the ceiling support member 16 sandwiched between the spacer member 14*a* and cooperating spacer member 14*b* is covered by at least one layer of material.

While the foregoing description provides what are considered to be preferred and exemplary embodiments of the present invention, other modifications of these embodiments also falling within the scope of the present invention will be apparent to those skilled in the art.

What is claimed is:

1. A ceiling baffle system comprising:

at least one ceiling support member having a horizontal flange portion extending longitudinally therealong;

at least one baffle extending transversely relative to the at least one ceiling support member, the at least one baffle having a baffle body portion with a baffle upper edge portion;

at least one receiving slot extending from the baffle upper edge portion into the baffle body portion and receiving at least a portion of the ceiling support member therewithin for coupling and suspending the at least one baffle from the at least one ceiling support member;

at least one spacer member extending parallel relative to the at least one ceiling support member and having a spacer member body portion and a spacer member lower edge portion, the spacer member body portion having therein at least one longitudinally extending groove for receiving therewithin and engaging by friction fit the horizontal flange portion of the at least one ceiling support member; and, at least one baffle retaining slot extending from the spacer member lower edge portion into the spacer member body portion, the baffle retaining slot receiving at least the baffle upper edge portion of the at least one baffle to position, angularly orient, and retain the at least one baffle relative to the at least one spacer member.

2. The ceiling baffle system of claim 1 wherein the at least one baffle further comprises at least one of woven polyethylene terephthalate (PET) fiber material, non-woven needle-punched PET fiber material, thermo-formed PET material, thermo-bonded PET material, cast PET material, and any combination thereof.

3. The ceiling baffle system of claim 1 wherein at least one of the at least one baffle and at least one spacer member comprise a plurality of material layers.

4. The ceiling baffle system of claim 3 wherein the plurality of material layers further comprise at least one layer of a PET material, and at least one of the layers of the plurality of material layers has at least one of a different thickness and a different density from the PET material.

5. The ceiling baffle system of claim 1 wherein at least one of the at least one baffle and the at least one spacer member comprises at least one acoustically absorbent material.

6. The ceiling baffle system of claim 1, wherein the at least one baffle retaining slot further comprises:

a plurality of baffle retaining slots spaced apart along the spacer member lower edge portion of the at least one spacer member for positioning a plurality of baffles in spaced apart position relative to one another.

7. The ceiling baffle system of claim 1 wherein the at least one spacer member further comprises at least one of woven polyethylene terephthalate (PET) fiber material, non-woven needle-punched PET fiber material, thermo-formed PET material, thermo-bonded PET material, cast PET material, and any combination thereof.

8. The ceiling baffle system of claim 1, further comprising:

a second horizontal flange portion extending longitudinally along the at least one ceiling support member and away from the horizontal flange portion; and, a cooperating spacer member having a second longitudinally extending groove therewithin for receiving therewithin and engaging by friction fit the second horizontal flange portion, the ceiling support member being sandwiched between the spacer member and the cooperating spacer member.

9. The ceiling baffle system of claim 8 further comprising:

at least one transverse ceiling support member intersecting with the at least one ceiling support member at a ceiling support member intersection; and, at least one adjustment notch extending from the spacer member lower edge portion into the spacer member body portion for allowing the at least one spacer member to slide along the at least one ceiling support member and across the ceiling support member intersection.

10. The ceiling baffle system of claim 9, further comprising:

a coupling wall portion extending between and coupling top edge portions of each of the spacer member and the cooperating spacer member; and, at least one second adjustment notch continuous with the at least one adjustment notch and extending at least partially across the coupling wall portion between the spacer member and the cooperating spacer member.

11. The ceiling baffle system of claim 8, further comprising:

a coupling wall portion extending between and coupling top edge portions of each of the spacer member and the cooperating spacer member.

12. The ceiling baffle system of claim 8, further comprising:

a longitudinal channel extending between the spacer member and the cooperating spacer member along a downward facing surface of the at least one ceiling support member.

13. The ceiling baffle system of claim 12, further comprising:

a linear luminaire extending within the longitudinal channel.

14. The ceiling baffle system of claim 1, further comprising:

at least one baffle deflection portion extending from the baffle body portion and positioned adjacent the at least one receiving slot, the at least one baffle deflection portion being deformable for widening an opening of the at least one receiving slot.

15. The ceiling baffle system of claim 14, wherein the at least one baffle deflection portion includes two baffle deflection portions, each baffle deflection portion of the two baffle deflection portions extending from the baffle body portion on opposing sides of the at least one receiving slot.

16. The ceiling baffle system of claim 15, wherein the two baffle deflection portions define therebetween a constricted neck portion of the at least one receiving slot.

17. The ceiling baffle system of claim 16, further comprising:

a transverse slot portion extending outwardly from an end portion of the constricted neck portion to define the at least one receiving slot as a T-shaped slot.

18. The ceiling baffle system of claim 17 wherein the at least one ceiling support member is a longitudinal T-shaped bar having a longitudinally extending vertical web portion and two longitudinally horizontal flange portions extending outwardly from an end portion of the longitudinally extending vertical web portion.

19. The ceiling baffle system of claim 1 wherein the at least one spacer member and the at least one baffle are slidable along the at least one ceiling support member.

20. The ceiling baffle system of claim 1 wherein the at least one spacer is configured to cover outwardly visible surfaces of the at least one ceiling support member when installed thereon.

21. The ceiling baffle system of claim 1 wherein the at least one spacer member has a bottom wall portion extending across a bottom surface portion of the at least one ceiling support member; and, a longitudinal channel extends along the bottom wall portion of the at least one spacer member.

22. The ceiling baffle system of claim 21, further comprising:

a linear luminaire extending within the longitudinal channel.

23. The ceiling baffle system of claim 1 wherein:

the at least one ceiling support member includes a plurality of ceiling support members spaced apart and parallel relative to one another;

the at least one baffle includes a plurality of baffles spaced apart relative to one another, each baffle of the plurality of baffles having a plurality of receiving slots spaced apart for receiving each one of the plurality of ceiling support members; and, the at least one spacer member includes a plurality of spacer members, each spacer member having a plurality of baffle retaining slots for retaining at least the baffle upper edge portion of each baffle therein.

24. The ceiling baffle system of claim 1 wherein the at least one ceiling support member is pre-existing, and the at least one baffle and at least one spacer member are retrofitted thereon.

25. A baffle system comprising:

a baffle having a longitudinal baffle body portion for extending transversely to at least one ceiling support member having a horizontal flange portion extending longitudinally therealong, the baffle body portion having a baffle upper edge portion;

at least one receiving slot extending from the baffle upper edge portion into the baffle body portion, for receiving at least a portion of the ceiling support member and for suspending the baffle therefrom;

a spacer member having a longitudinal spacer member body portion for extending parallel relative to the at least one ceiling support member, the spacer member body portion having a lower edge portion and a longitudinally extending groove therein for receiving therewithin and engaging by friction fit the horizontal flange portion of the at least one ceiling support member; and, at least one baffle retaining slot extending from the lower edge portion of the spacer member into the body portion of the spacer member, for receiving at least a portion of the baffle to position, angularly orient, and retain the baffle relative to the at least one spacer member.

26. The baffle system of claim 25, wherein the baffle comprises at least one of woven PET fiber material, non-woven needle-punched PET fiber material, thermo-formed PET material, thermo-bonded PET material, cast PET material, and any combination thereof.

27. The baffle system of claim 25, wherein at least one of the baffle and the spacer member comprises at least one acoustically absorbent material.

28. The baffle system of claim 25, further comprising:

at least one baffle deflection portion extending from the baffle body portion and positioned adjacent the at least one receiving slot, the at least one baffle deflection portion being deformable for widening an opening of the at least one receiving slot.

29. The baffle system of claim 28, further comprising:

two baffle deflection portions extending from the baffle body portion on opposing sides of the at least one receiving slot.

30. The baffle system of claim 29, wherein the two baffle deflection portions define therebetween a constricted neck portion of the at least one receiving slot.

31. The baffle system of claim 30 further comprising:

a transverse slot portion extending outwardly from an end portion of the constricted neck portion to define the at least one receiving slot as a T-shaped slot.

32. The baffle system of claim 25, wherein the spacer member further comprises at least one of woven PET fiber material, non-woven needle-punched PET fiber material, thermo-formed PET material, thermo-bonded PET material, cast PET material, and any combination thereof.

33. The baffle system of claim 25, further comprising:

at least one adjustment notch extending from the lower edge portion of the spacer member into the body portion of the spacer member for allowing the spacer member to slide along the ceiling support member and across a ceiling support member intersection wherein the ceiling support member intersects with a transverse ceiling support member.

34. The baffle system of claim 25, wherein the spacer member has a bottom wall portion for extending across a bottom surface portion of the at least one ceiling support member; and, a longitudinal channel extends along the bottom wall portion of the spacer member.

35. The baffle system of claim 25 further comprising:

a cooperating spacer member having a second longitudinally extending groove therewithin for receiving therewithin and engaging by friction fit a second portion of the ceiling support member for sandwiching the ceiling support member between the spacer member and the cooperating spacer member.

36. The baffle system of claim 35, further comprising:

a coupling wall portion extending between and coupling top edge portions of each of the spacer member and the cooperating spacer member.

37. The baffle system of claim 25, further comprising:

a cooperating spacer member having a second longitudinally extending groove therewithin for receiving therewithin and engaging by friction fit a second portion of the ceiling support member for sandwiching the ceiling support member between the spacer member and the cooperating spacer member.

38. The baffle system of claim 37, further comprising:

a coupling wall portion extending between and coupling top edge portions of each of the spacer member and the cooperating spacer member; and, at least one second adjustment notch continuous with the at least one adjustment notch and extending at least partially across the coupling wall portion between the spacer member and the cooperating spacer member.

* * * * *